United States Patent [19]

Angelico

[11] 4,078,519

[45] Mar. 14, 1978

[54] ELECTROSTATICALLY CHARGED FLUIDIZED BED

[75] Inventor: Henry R. Angelico, Devon, Conn.

[73] Assignee: Poly-Clad Equipment Corporation, West Haven, Conn.

[21] Appl. No.: 765,211

[22] Filed: Feb. 2, 1977

[51] Int. Cl.[2] ..... B05B 5/02

[52] U.S. Cl. ..... 118/629; 118/DIG. 5

[58] Field of Search ..... 118/627, 629, DIG. 5, 118/429, 630, 631, 632; 117/DIG. 6; 427/21

[56] References Cited

U.S. PATENT DOCUMENTS

| | | | |
|---|---|---|---|
| 2,667,706 | 2/1954 | Morse et al. | 117/DIG. 6 |
| 3,197,328 | 7/1965 | Jung et al. | 118/DIG. 5 |
| 3,254,625 | 6/1966 | Armstrong | 118/DIG. 5 |
| 3,261,707 | 7/1966 | Korski et al. | 118/DIG. 5 |
| 3,464,384 | 9/1969 | Miller et al. | 117/DIG. 6 |
| 3,817,211 | 6/1974 | Brown et al. | 118/627 X |
| 3,871,328 | 3/1975 | English | 118/DIG. 5 X |
| 3,892,357 | 7/1975 | Tamny | 118/629 X |

FOREIGN PATENT DOCUMENTS

| | | | |
|---|---|---|---|
| 178,289 | 6/1966 | U.S.S.R. | 118/DIG. 5 |

*Primary Examiner*—Wm. Carter Reynolds
*Attorney, Agent, or Firm*—McCormick, Paulding & Huber

[57] ABSTRACT

An electrostatic fluidized bed apparatus having a housing supporting a removable container defining a fluidizing bed and a plenum chamber and having a porous insulated partition therebetween containing an electrode. When the container is positioned in the housing of the plenum chamber is automatically connected to an air pressure source and the electrode is automatically connected to a high voltage electrical power source and vibration system contained within the housing. The container may be used as a powder storage bin when removed from the housing.

20 Claims, 4 Drawing Figures

ELECTROSTATICALLY CHARGED FLUIDIZED BED

BACKGROUND OF THE INVENTION

This invention relates in general to electrostatic fluidized bed apparatus and deals more particularly with improved apparatus for coating articles by the electrostatic deposition of particulate material.

The advantages of electrostatic powder coating are well known and apparatus of the type in general use for the application of such coating usually comprises some form of permanent or semipermanent installation which requires external supporting equipment, which may, for example, comprise an air compressor, or high voltage electrical source connected to the equipment by plumbing or electrical lines. Such equipment is particularly well suited for use where a single coating material is to be applied to a relatively large volume of work. However, when the coating material is changed, it is generally necessary to shut down the equipment and thoroughly clean the fluidizing bed so that the material to be used in the next production run will not be contaminated by material used in the previous run. Further, if the equipment is of a type which employs exposed electrodes, a relatively large quantity of powdered coating material must be used even though the fluidizing bed may be relatively small, since it is usually necessary that the coating material cover the electrodes to assure efficient operation. In such an installation the electrodes must also be cleaned whenever the coating material is changed to avoid risk of contamination. The resulting down time is costly and tends to offset advantages derived from the use of such equipment in short run production. Consequently, such apparatus has not realized its full potential for use in the short run production of articles requiring coatings of differing colors or materials or for laboratory use. The present invention is concerned with the aforedescribed problems.

SUMMARY OF THE INVENTION

In accordance with the present invention an improved portable electrostatic fluidized bed apparatus is provided which comprises a substantially self-contained unit and which includes a housing containing a vibrator mechanism, an air pressure source, and a high voltage electrical power source. A removable container supported within an opening at the upper end of the housing comprises a fluidized bed and a plenum chamber and carries an electrode which is physically isolated from the fluid bed. The detachable container may be used as a storage bin for coating material and may be arranged for automatic coupling with the vibrator mechanism, air source and high voltage power source when it is positioned in the housing.

DETAILED DESCRIPTION OF PREFERRED EMBODIMENT

Figure 1:
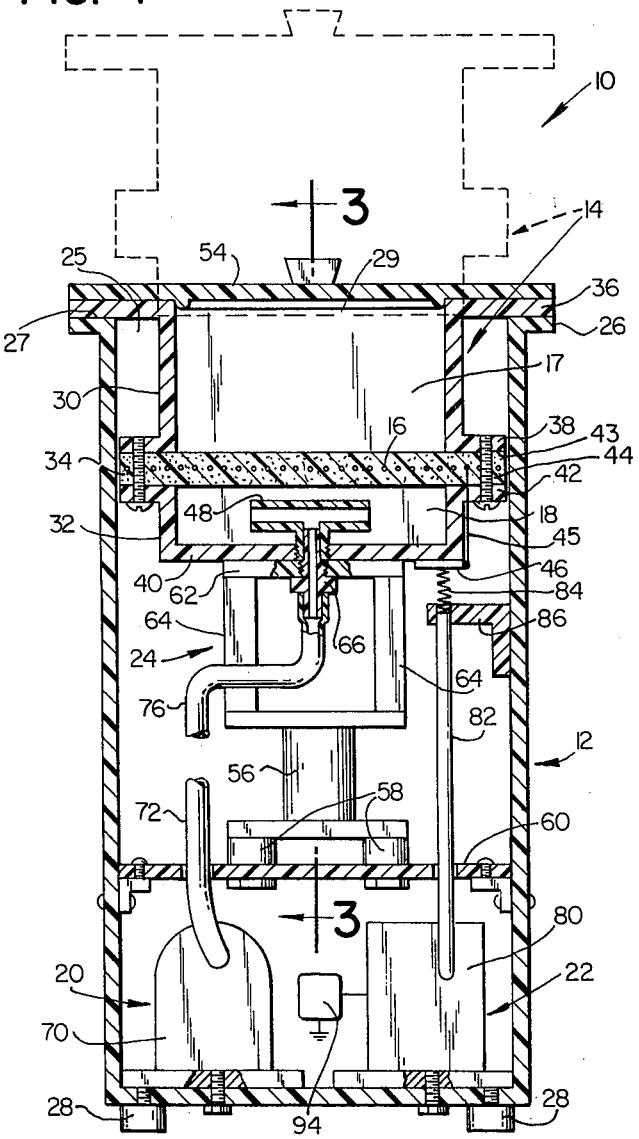
FIG. 1 is a somewhat schematic vertical sectional view of an electrostatic fluidized bed apparatus embodying the present invention.

Turning now to the drawing, an electrostatic fluidized bed apparatus embodying the present invention is indicated generally by the reference numeral 10 in FIG. 1. The illustrated fluidized bed apparatus 10 is a portable apparatus particularly suitable for laboratory research work or short run production and comprises a housing, designated generally by the numeral 12, which has an opening at its upper end. A removable container indicated generally at 14 is supported in the opening in the housing and carries an electrode 16. The container 14 also defines a fluidizing chamber 17 and a plenum chamber 18. The apparatus 10 is a self-contained unit and has a gas or air pressure source contained in the housing, and indicated generally at 20, and a high voltage power source, designated generally by the numeral 22, also contained within the housing 12. The apparatus 10 further includes a vibrator mechanism indicated generally at 24 which is also mounted in the housing 12. Means are provided for automatically connecting the air pressure source 20 to the plenum chamber 18 and the high voltage power source 22 to the electrode 16 and for automatically coupling the vibrator 24 to the container 14 when the container is positioned in the housing 12, as shown in FIG. 1, all of which will be hereinafter further described.

Considering now the apparatus 10 in further detail, the housing 12 may be constructed from any suitable material, but preferably it is molded from a dielectric plastic material such as polyethylene, and has a bottom wall and four side walls which define generally rectangular opening 25 at the upper end. An outwardly directed flange 26 surrounds the opening 25 and defines an upwardly facing support lip 27. Shock mounts 28, 28, fastened to the bottom wall of the housing 12, support the apparatus 10 on a floor surface or the like.

Figure 4:
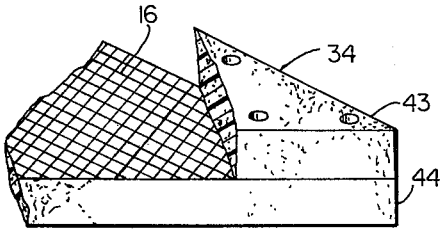
FIG. 4 is a fragmentary perspective view of a portion of the apparatus of FIG. 1.

The removable container 14 is generally rectangular, has an opening 29 at its upper end, and is formed by an upper part 30, a lower part 32, and a generally rectangular porous plate 34 which forms a partition between the upper and lower parts 30 and 32 and contains the electrode 16. The upper and lower parts 30 and 32 are preferably formed from a dielectric plastic material such as polyethylene or the like. The upper part 30 has four side walls and a generally rectangular outwardly directed flange 36 which surrounds the opening 29 at its upper end. A similar but somewhat outwardly directed rectangular flange 38 surrounds the lower end of the housing part 30. The lower part 32 has four side walls and a bottom wall 40. An outwardly directed rectangular flange 42, similar to the flange 38, surrounds the upper end of the housing part 32, substantially as shown. The porous plate 34 is made from two sheets of porous electrical insulating material 43 and 44 and is preferably made porous dielectric plastic material such as polyethylene. An aluminum screen which comprises the electrode 16 is sandwiched between the plates 43 and 44, as best shown in FIG. 4. The flanges 38 and 42 are secured together by suitable fasteners with the porous plate 34 disposed therebetween, substantially, as shown in FIG. 1. An electrical conductor 45 connects the electrode 16 to an electrical contact plate 46 exposed at the bottom of the container 14 and adhered or otherwise secured to the lower surface of the bottom 40.

Figure 2:
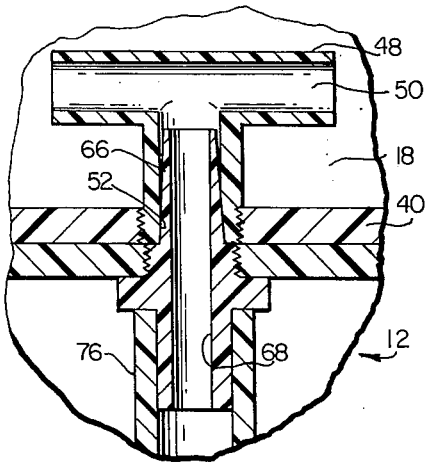
FIG. 2 is a somewhat enlarged fragmentary view of a portion of the apparatus as shown in FIG. 1.

The upper portion of the container 14 defined by the part 30 and the upper surface of the porous plate 34 comprises the fluidizing chamber 17 whereas the lower part 32 and the lower surface of the plate 34 define the plenum chamber 18. A manifold or T-shaped conduit 48 threaded into or otherwise secured to the bottom 40 and has an air inlet passageway 50 which opens through the bottom and communicates with the interior of the plenum chamber 18. At its lower end the passageway 50 has a generally conically upwardly diverging inlet opening 52, best shown in FIG. 2. A cover 54 provides a closure for the opening 29 at the upper end of the container 14.

Figure 3:
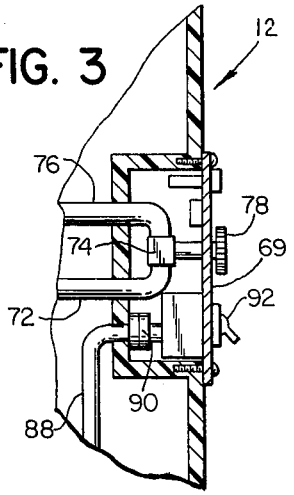
FIG. 3 is a fragmentary sectional view taken along the line 3—3 of FIG. 1.

The vibrator mechanism 24 includes an electrically operated vibrator 56 carried by resilient shock mounts 58, 58 fastened to a support plate 60. The latter support plate is secured by threaded fasteners to brackets riveted or otherwise attached to the side walls of the housing 12 substantially as shown in FIG. 1. A vibrator plate 62 is supported above the vibrator 56 and in vertically spaced relation thereto by a plurality of parallel support posts 64, 64, which are made from dielectric material and extend upwardly from the vibrator 56. The vibrator plate 62 is arranged for face-to-face engagement with the container bottom 40 and serves to couple the vibrator to the container 14. An air output stem 66 threaded into or otherwise fastened to the vibrator plate 62 provides an air outlet passageway 68 through the plate 62. The upper end portion of the stem 66, projects above the vibrator plate 62 and has a conically upwardly diverging peripheral surface for complementary engagement with the manifold conduit 48 within the conical opening 52 at the lower end of the air inlet passageway for telescopically connecting the tubular stem 66 with the tubular manifold conduit 48. A suitable manually operated control device (not shown) is provided for adjusting the cyclical output of the vibrator mechanism 24 and may be mounted on a control panel 69 secured to an associated sidewall of the housing 12, as shown in FIG. 3.

The air source 20 preferably comprises an air pump 70 of the diaphragm type, mounted in the housing 12 below the container 14 and secured to the bottom wall of the housing as shown in FIG. 1. A flexible air line 72 is connected to the air pump 70 and to an air regulator valve 74 which is, in turn, connected by another flexible airline 76 to the lower end of the stem 66. The regulator valve 74 is mounted on the control panel 69 and disposed within a recess in a sidewall of the housing as shown in FIG. 3. A control knob 78 is exposed externally of the housing for manually regulating the valve 74 to adjust the volumetric output of air from the pump 70.

The high voltage electrical power source 22 comprises a high voltage transformer 80 and supporting electrical circuitry (not shown) mounted within the housing 12 below the container 14 and preferably secured to the bottom wall of the housing, substantially as shown. The transformer 80 is connected by a high voltage cable 82 to a contact spring 84. The latter spring is supported immediately below the contact plate 46 and is carried by a support bracket 86 mounted on a side wall of the housing 12. The transformer 80 is connected by another electrical conductor 88 through a jack and receptacle assembly 90 to a suitable voltage regulating device 92 mounted on the control panel and accessible externally of the housing as best shown in FIG. 3. The high voltage control circuit is provided with an automatic sensing device schematically indicated at 94 in FIG. 1, to aid in the prevention of high voltage arcing. The device 94 is connected between the power supply and ground and comprises current sensing means responsive to a predetermined current in the electrical circuit associated with the high voltage transformer 90 to interrupt power thereto or otherwise limit current flow in said associated circuit. The apparatus 10 may be provided with a regulator (not shown) for adjusting the predetermined current to which the sensing will respond. In the illustrated fluidized bed apparatus 10 the device 94 comprises a Current Limiter 2D21 supplied by Hi Potronics Brewster, New York, which is used to automatically shut-off power to the transformer 90 in response to a predetermined current condition. Shut-off switches reset buttons and other conventional electrical controls as may be required for operating and regulating the air pump, the vibrator and the high voltage transformer are also mounted on the control panel 69, but are not shown. Such control devices are well known in the art and need not be described in detail.

When the container 14 is positioned within the housing 12 the flanges 38 and 42 generally cooperate with the interior surface of the housing sidewalls to guide the passageway 52 into connected engagement with the upwardly extending stem 66. Suitable indicia may be provided on the container 14 and on the housing 12 to assure proper orientation of the container relative to the housing so that the spring member 84 will engage the plate 46 to establish high voltage electrical connection between the transformer and the electrode 16. When the container 14 is fully seated within the housing the upper flange 36 engages the lip 26 to generally support the container therein. The container bottom 40 rests upon the vibrator plate 62 whereby coupled engagement is established between the container 14 and vibrator mechanism 24. If desired, the container flange 36 may be clamped in engagement with the flange 26 on the housing to maintain positive engagement between the vibrator plate 62 and the container bottom 40 for increased vibrator efficiency.

Air is pumped into the plenum chamber 18 through the air lines 72 and 76 and the regulator 74 and is diffused, as may be required, by the manifold 48. As air passes upwardly from the plenum chamber 18 through the porous plate 34 it is ionized by the electrode 16. The rising air causes fluidization of powdered coating material contained within the fluidizing chamber 17, as is well known in the art. As air passes through the porous plate it is further diffused and tends to lift the powder in the chamber 17 in a relatively uniform manner and retain it in substantially uniform suspension. Since the fluidizing air is ionized by the electrodes before reaching the powder, the apparatus may be operated with an extremely small quantity of powder in the container. There are no baffles, electrodes or frames in the path of the powder within the fluidization chamber 17, consequently, the powder will be lifted in substantially uniform distribution within the chamber and toward the substrate to be coated to assure efficient uniform coating thereof.

I claim:

1. Electrostatic fluidized bed apparatus comprising a housing having an opening in its upper end, an upwardly opening removable container positioned in said opening and removably supported in the upper end of said housing, said removable container having a porous partition separating an upper portion from a lower portion thereof and cooperating with walls of said container to define a fluidization chamber in said upper portion and a plenum chamber in said lower portion, electrode means disposed within said container, a source of gas under pressure contained in said housing, a high voltage electrical power source contained within said housing, and means automatically connecting said plenum chamber in communication with said source of gas and for automatically connecting said electrode means to said high voltage electrical power source when said container is positioned in said housing.

2. Electrostatic fluidized bed apparatus as set forth in claim 1 wherein said apparatus includes a manifold disposed within said plenum chamber and said means for automatically connecting said plenum chamber is further characterized as means for automatically connecting said manifold to said source of gas.

3. Electrostatic fluidized bed apparatus as set forth in claim 1 wherein said plenum chamber and said source of gas have tubular connecting members associated therewith and said means for automatically connecting said plenum chamber comprises means for telescopically connecting said tubular connecting members.

4. Electrostatic fluidized bed apparatus as set forth in claim 3 wherein said source of gas comprises a diaphragm pump and said means for automatically connecting said plenum chamber in communication with said source of gas comprises a hose connected to said diaphragm pump.

5. Electrostatic fluidized bed apparatus as set forth in claim 3 wherein said means for telescopically connecting said tubular connecting members comprises complimentary tapered surfaces on said tubular connecting members.

6. Electrostatic fluidized bed apparatus as set forth in claim 1 wherein said means for automatically connecting said electrode means to said power source comprises an electrically conductive plate member and a spring member for engaging said plate member, one of the members comprising said spring member and said plate member being mounted on said container and connected to said electrode means and the other of said members being mounted in said housing and connected to said power source.

7. Electrostatic fluidized bed apparatus as set forth in claim 1 wherein said partition comprises dielectric material and said electrode means is embedded in said dielectric material inwardly of the surfaces thereof.

8. Electrostatic fluidized bed apparatus as set forth in claim 7 wherein said electrode means comprises a wire mesh screen, said dielectric material comprises layers of porous dielectric material, and said screen is sandwiched between said layers of porous dielectric material.

9. Electrostatic fluidized bed apparatus as set forth in claim 1 wherein said housing has an upwardly facing lip surrounding said opening and said container has a flange generally engaging said lip when said container is received in said opening.

10. Electrostatic fluidized bed apparatus as set forth in claim 1 including means within said housing for vibrating said container.

11. Electrostatic fluidized bed apparatus as set forth in claim 10 including means for automatically coupling said container to said vibrating means when said container is positioned within said housing.

12. Electrostatic fluidized bed apparatus as set forth in claim 11 wherein said coupling means comprises a plate engaging the bottom surface of said container when said container is positioned in said housing.

13. Electrostatic fluidized bed apparatus as set forth in claim 12 wherein said vibrating means comprises an electrically operated vibrator motor mounted in said housing and dielectric means drivingly connecting said plate to said vibrator motor and supporting said plate in spaced relation to and above said vibrator motor.

14. Electrostatic fluidized bed apparatus as set forth in claim 13 wherein said dielectric means comprises a plurality of elongated posts.

15. An electrostatic fluidized bed apparatus as set forth in claim 1 wherein said high voltage power source includes an electrical circuit and electrical current sensing means responsive to a predetermined current in said electrical circuit for altering the condition of said circuit.

16. Electrostatic fluidized bed apparatus comprising a housing having an opening in its upper end, an upwardly opening removable container positioned in said opening and removable supported in the upper end of said housing, said removable container having a porous partition separating an upper portion from a lower portion thereof and cooperating with walls of said container to define a fluidization chamber in said upper portion and a plenum chamber in said lower portion, electrode means disposed within said container, a vibrator mechanism including a plate for engaging the bottom surface of said container, an electrically operated vibrator motor mounted in said housing below said container, and dielectric means drivingly connecting said plate to said vibrator motor and supporting said plate in spaced relation to and above said vibrator motor, gas pressure generating means supported in said housing below said container and connected in communication with said plenum chamber to supply gas under pressure thereto, and a high voltage electrical power source supported in said housing below said container and electrically connected in circuit to said electrode means.

17. Electrostatic fluidized bed apparatus as set forth in claim 16 wherein said dielectric means comprises a plurality of elongated posts.

18. An electrostatic fluidized bed apparatus as set forth in claim 16 including electrical current sensing means responsive to a predetermined current in said circuit for altering the condition of said circuit.

19. Electrostatic fluidized bed apparatus comprising a housing having an opening in its upper end, an upwardly opening removable container positioned in said opening and removable supported in the upper end of said housing, said removable container having a porous partition separating an upper portion from a lower portion thereof and cooperating with walls of said container to define a fluidization chamber in said upper portion and a plenum chamber in said lower portion, an electrode disposed within said container, a vibrator mechanism contained within said housing including, a vibrator motor, a plate, and a plurality of elongated posts drivingly connecting said plate to said vibrator motor and supporting said plate in spaced relation to said vibrator motor for engagement with said container when said container is supported in said housing, gas pressure generating means supported in said housing below said container and connected in communication with said plenum chamber to supply gas under pressure thereto, and a high voltage electrical power source supported in said housing below said container and electrically connected to said electrode.

20. Electrostatic fluidized bed apparatus as set forth in claim 12 wherein said vibrating means includes a vibrator motor and a plurality of elongated posts drivingly connected to said vibrator motor and said plate and supporting said plate in spaced relation to said vibrator motor.

* * * * *